US010023351B2

(12) United States Patent
Imai et al.

(10) Patent No.: US 10,023,351 B2
(45) Date of Patent: Jul. 17, 2018

(54) BOX AND PACKAGE

(71) Applicant: FUJI XEROX CO., LTD., Tokyo (JP)

(72) Inventors: Seiya Imai, Kanagawa (JP); Seiji Ogawa, Kanagawa (JP); Keigo Yamada, Kanagawa (JP); Yohei Suzuki, Kanagawa (JP); Kenji Matsuura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/345,625

(22) Filed: Nov. 8, 2016

(65) Prior Publication Data

US 2017/0361975 A1 Dec. 21, 2017

(30) Foreign Application Priority Data

Jun. 17, 2016 (JP) ..... 2016-120381

(51) Int. Cl.

| | |
|---|---|
| ***B65D 85/30*** | (2006.01) |
| ***B65D 5/66*** | (2006.01) |
| ***B65D 5/02*** | (2006.01) |
| ***B65D 5/42*** | (2006.01) |
| ***B65D 5/50*** | (2006.01) |
| ***B65D 81/113*** | (2006.01) |

(52) U.S. Cl.

CPC ..... *B65D 5/6655* (2013.01); *B65D 5/0254* (2013.01); *B65D 5/4266* (2013.01); *B65D 5/5028* (2013.01); *B65D 81/113* (2013.01)

(58) Field of Classification Search

CPC .. B65D 5/6655; B65D 5/0254; B65D 5/4266; B65D 5/5028; B65D 81/113

USPC ..... 206/587, 592

See application file for complete search history.

(56) References Cited

U.S. PATENT DOCUMENTS 5,372,259 A * 12/1994 Suzuki ..... B65D 5/5004 206/586

FOREIGN PATENT DOCUMENTS

| | | |
|---|---|---|
| JP | 2003-026146 A | 1/2003 |
| JP | 2011-121611 A | 6/2011 |

* cited by examiner

*Primary Examiner* — King M Chu

(74) *Attorney, Agent, or Firm* — Sughrue Mion, PLLC

(57) ABSTRACT

A box includes: a box body having an opening surrounded by multiple edges; a first lid body that is continuous with and extends from a first edge, among the multiple edges defining the opening in the box body, and that is foldable along the first edge to overlie the opening; and an engaging tab that is continuous with and extends from a second edge, which is different from the first edge, among multiple edges of the first lid body, and that is foldable and engageable with a storage item stored in the box body when the first lid body is folded along the first edge to overlie the opening.

20 Claims, 5 Drawing Sheets

BOX AND PACKAGE

CROSS-REFERENCE TO RELATED APPLICATIONS

This application is based on and claims priority under 35 USC 119 from Japanese Patent Application No. 2016-120381 filed Jun. 17, 2016.

BACKGROUND

Technical Field

The present invention relates to boxes and packages.

SUMMARY

According to an aspect of the invention, there is provided a box including: a box body having an opening surrounded by plural edges; a first lid body that is continuous with and extends from a first edge, among the plural edges defining the opening in the box body, and that is foldable along the first edge to overlie the opening; and an engaging tab that is continuous with and extends from a second edge, which is different from the first edge, among plural edges of the first lid body, and that is foldable and engageable with a storage item stored in the box body when the first lid body is folded along the first edge to overlie the opening.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below.

Figure 1:
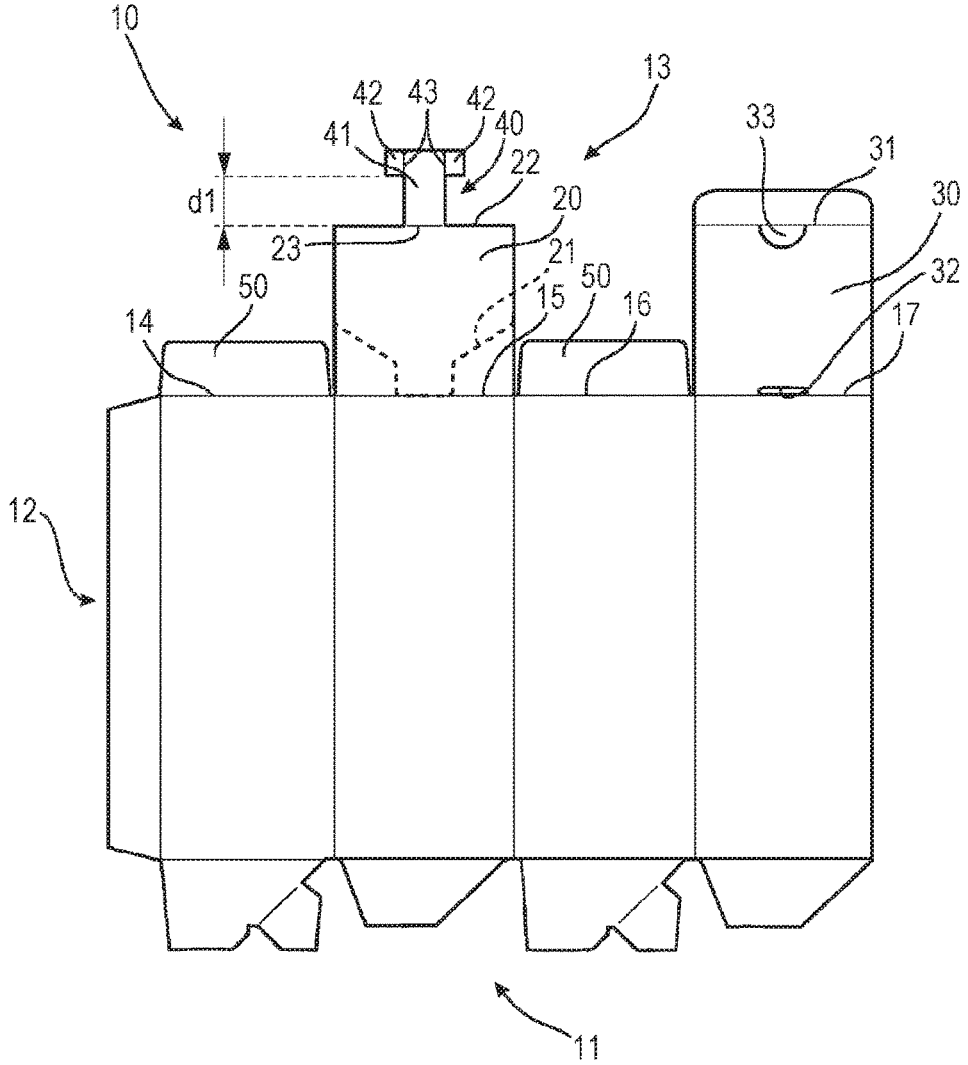
FIG. 1 is a developed view of a box, serving as an exemplary embodiment of the present invention.

FIG. 1 is a developed view of a box, serving as an exemplary embodiment of the present invention. Herein, for ease of explanation, a box before being arranged into a box is also referred to as a box, without distinction from a completed box.

A box 10 according to this exemplary embodiment, as shown in FIG. 1, is made of cardboard or corrugated paperboard. The box 10 is cut into the shape as shown in FIG. 1, is folded, is joined at a bottom part 11 and a side part 12, and, thus, is completed as a box. In a top part 13 of the completed box 10, a rectangular opening 19 (see FIG. 2A) surrounded by four edges 14, 15, 16, and 17 is formed.

In the top part 13 of the box 10, a first lid 20 and a second lid 30 are provided. The first lid 20 is continuous with and extends from the edge 15 of the four edges, 14 to 17, defining the opening 19. The first lid 20 is folded along the edge 15, serving as a crease, to overlie the opening 19. The second lid 30 is continuous with and extends from the edge 17, which is located opposite the edge 15, of the four edges, 14 to 17, defining the opening 19. The second lid 30 is folded along the edge 17 and is also folded along a crease 31 to cover the opening 19, on the inner side of the first lid 20. The first lid 20 and the second lid 30 are an example of a first lid body and an example of a second lid body of the present invention, respectively, and the edge 15 and the edge 17 are an example of a first edge and an example of a third edge of the present invention, respectively.

The first lid 20 continuous with and extending from the edge 15 is provided with perforation lines 21. The perforation lines 21 allow the box 10 to be torn therealong, when the box 10 is duly opened.

The box 10 is provided with an engaging tab 40. In this exemplary embodiment, the engaging tab 40 is continuous with and extends from an edge 22 located opposite the edge 15, which defines the opening 19. The edge 22 corresponds to an example of a second edge of the present invention. The engaging tab 40 includes a base part 41 and a pair of wing parts 42. The base part 41 extends from the edge 22 of the first lid 20. The pair of wing parts 42 extend from a distal end of the base part 41, which is located opposite the edge 22, in two directions parallel to the edge 22. The pair of wing parts 42 are folded toward the interior of the box 10 along creases 43, that is, along the edges of the base part 41. The base part 41 is also folded along a crease 23 on the proximal end thereof, that is, along the edge 22 of the first lid 20 (see FIG. 2B).

The second lid 30 is provided with a slit 32, into which the engaging tab 40 is inserted, at the proximal end thereof, which is the edge 17. The second lid 30 is also provided with a tab 33, which is a semicircular cut, at a portion near the crease 31. By pulling up the tab 33, the second lid 30 that closes the opening 19 (FIG. 2A) can be opened.

The box 10 also includes two flaps 50 that are continuous with the two edges 14 and 16, among the four edges defining the opening 19, other than the two edges 15 and 17 that are continuous with the first lid 20 and the second lid 30. These flaps 50 are folded along the edges 14 and 17, serving as creases.

Figure 2A:
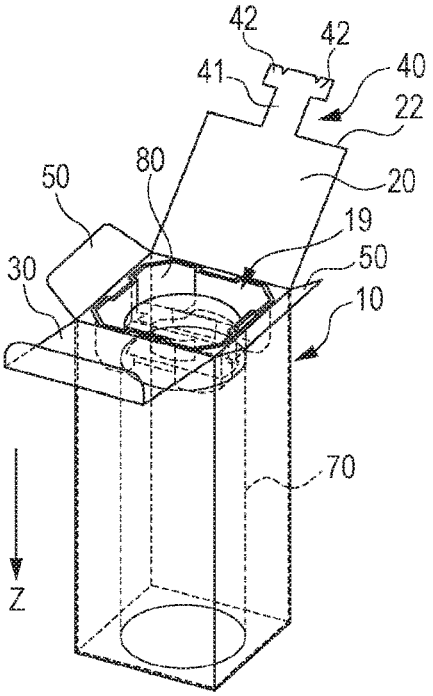
FIGS. 2A to 2D show the process of closing the box.

FIGS. 2A to 2D show the process of closing the box. FIG. 2A shows a state in which a storage item is stored in the box 10, and the opening 19 in the box 10 is still open. The storage item in this exemplary embodiment includes a principal storage item (herein, a product 70), which is packaged in the box 10 for transport or storage, and a cushioning member 80 for protecting the product 70 from shock or the like. The cushioning member 80 is disposed immediately inside the opening 19. Although not illustrated herein, another cushioning member, either in the same shape as or in a different shape from the cushioning member 80, may be disposed at the end of the product 70 opposite to the end provided with the cushioning member 80. Herein, the shape or type of the product 70 does not matter, so, it is simply illustrated as a cylinder. Meanwhile, the cushioning member 80 as illustrated herein has a characteristic shape, but the description thereof will be given below, and the process of closing a lid of the box 10 will be described first.

As shown in FIG. 2A, the storage items to be stored in the box 10, namely, the product 70 and the cushioning member 80, are stored in the box 10 such that the cushioning member 80 is closer to the opening 19.

Next, as shown in FIG. 2A, the two flaps 50 are folded, and the second lid 30 is folded to close the opening 19. Furthermore, the wing parts 42 of the engaging tab 40 are folded along the edges of the base part 41, and the base part 41 is folded along the edge 22. Then, the base part 41 is inserted into the slit 32 in the second lid 30, which has previously been closed, with the wing parts 42 being held on the base part 41 (FIG. 2C). The dimension dl (see FIG. 1) between the proximal end of the engaging tab 40, the proximal end being continuous with the first lid 20, and the wing parts 42 is substantially equal to or slightly larger than the dimension d2 (see FIG. 3) of the corresponding part in the cushioning member 80. Hence, the engaging tab 40 inserted from the slit 32 reaches a lower surface (a surface facing the direction of an arrow Z) of the corresponding part of the cushioning member 80. The wing parts 42 of the engaging tab 40 then open, due to their own elasticity, to some extent in the directions away from the base part 41 and are engaged with the lower surface of the cushioning member 80 (FIG. 2D).

The box 10 according to this exemplary embodiment is characterized in that the engaging tab 40 is engaged with the storage item (in this exemplary embodiment, the cushioning member 80) stored in the box 10, not with the inner wall (for example, an inner surface of the second lid 30) of the box 10. In this case, the engaging position where the engaging tab 40 is engaged is located on the deeper side of the opening 19, thus making access to the engaging part from outside the box 10 extremely difficult. Therefore, with this exemplary embodiment, even without a downstream step, such as a bonding step, tampering, in which the box 10 is opened and closed without any evidence of opening, can be effectively prevented.

Next, the shape of the cushioning member 80 and the relationship between the cushioning member 80 and the engaging tab 40 will be described.

Figure 3:
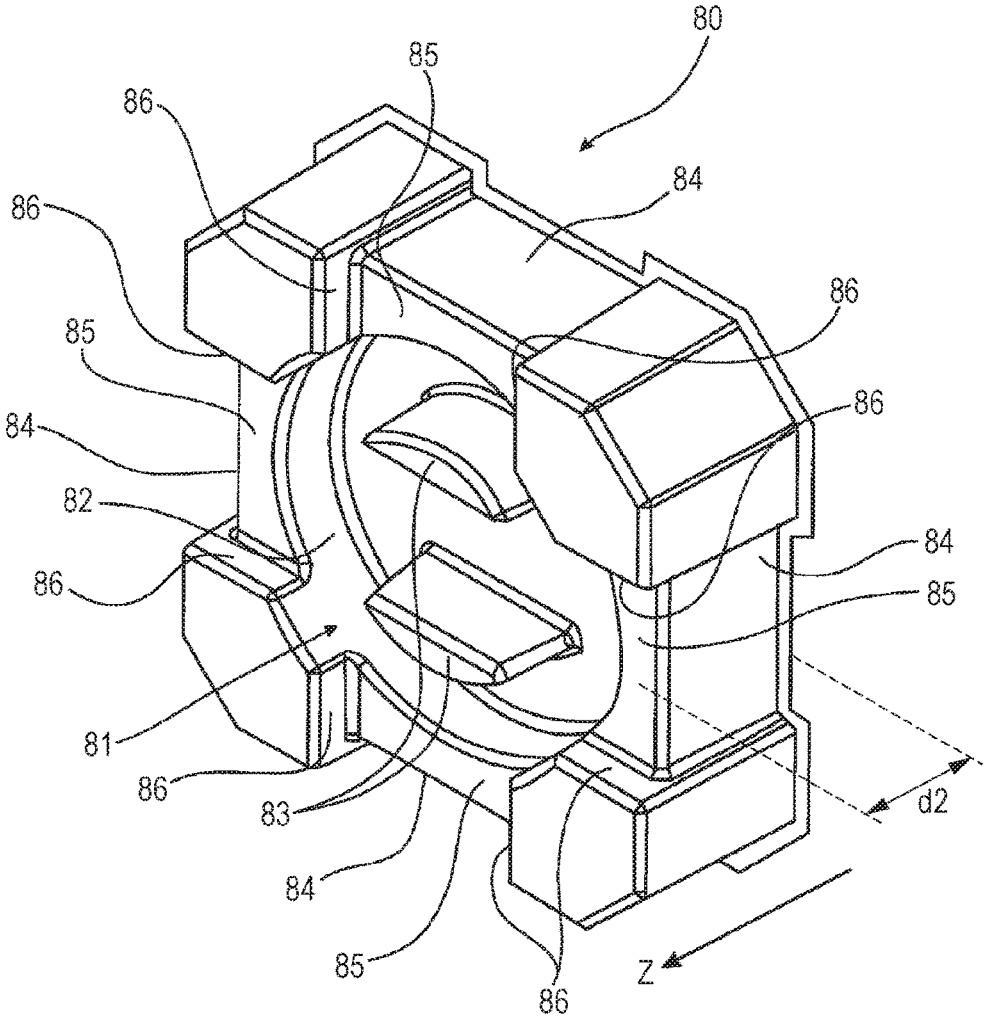
FIG. 3 is a perspective view of a cushioning member.

FIG. 3 is a perspective view of the cushioning member.

The cushioning member 80 according to this exemplary embodiment is made of a light-weight, transparent resin. The cushioning member 80 is stored in the box 10 in such an orientation that the arrow Z direction in FIG. 3 matches the arrow Z direction in FIG. 2. FIG. 3 shows a lower surface 81 of the cushioning member 80, the lower surface 81 facing the arrow Z direction. The lower surface 81 has, in the central part thereof, a product-retaining part 82, which is recessed from the part surrounding it. The product-retaining part 82 has, in the central part thereof, projections 83 for keeping the orientation of the product 70 retained by the product-retaining part 82. The cushioning member 80 has a substantially square shape with the four corners chamfered and the four edges recessed, as viewed in the arrow Z direction. Herein, these recessed parts are referred to as first recessed parts 84, such that they are distinguished from second recessed parts 85 described below. The cushioning member 80 not only has a substantially square shape as a whole, as viewed in the arrow Z direction, but also is provided with parts required to be engaged with the engaging tab 40, at four positions that are shifted in phase by 90°. Thus, the cushioning member 80 may be stored in the box 10 in any of the four orientations differing by 90°. As has been described above, the cushioning member 80 according to this exemplary embodiment has such a shape that it can be stored in the box 10 in any of the several orientations and, hence, has high orientation flexibility when stored in the box 10, which improves packaging efficiency.

Figure 2B:
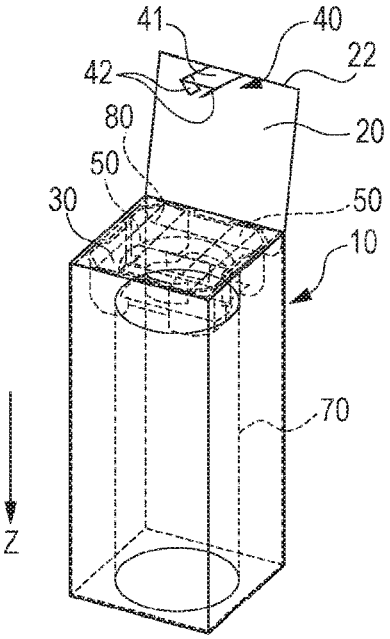
Figure 2C:
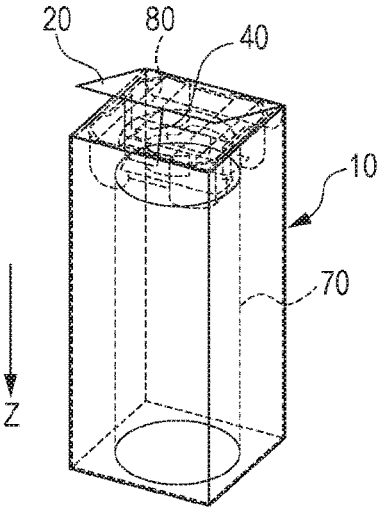
Figure 2D:
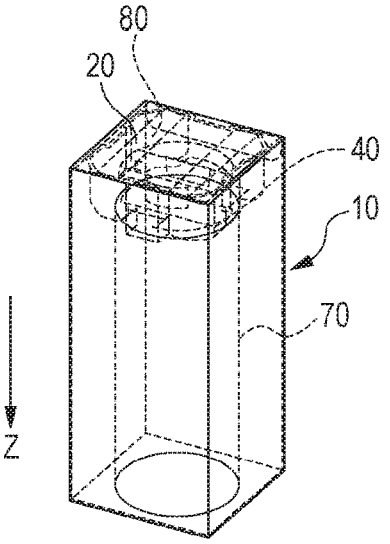
Figure 4:
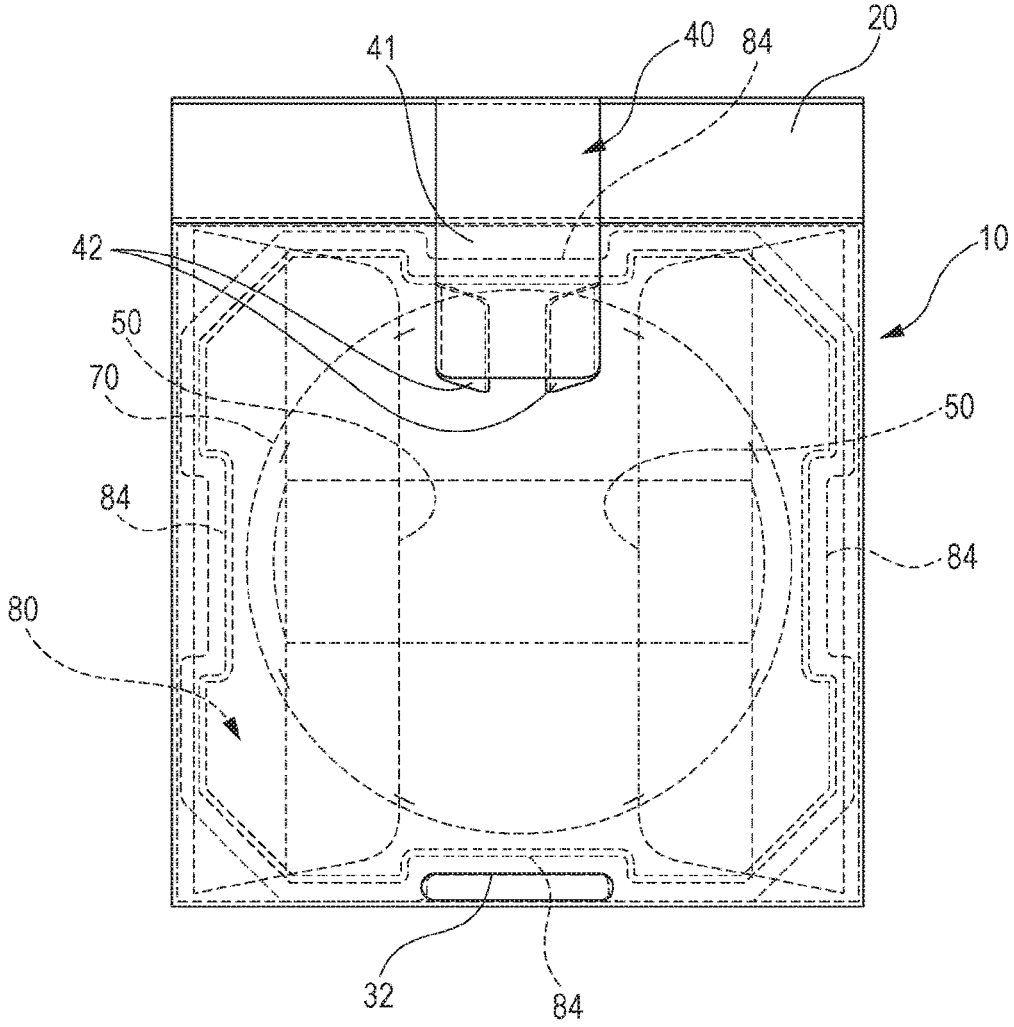
FIG. 4 is a plan view of the box in a state shown in FIG. 2B.

FIG. 4 is a plan view of the box in the state shown in FIG. 2B.

FIG. 4 shows the cushioning member 80 stored in the box 10. One of the four first recessed parts 84 of the cushioning member 80 is located at a position overlapping the slit 32 in the second lid 30 in the top-bottom direction. In this state, the first lid 20 is folded so as to overlie the second lid 30, and the engaging tab 40 is inserted into the slit 32.

The first recessed parts 84 and the inner walls of the box 10 form gaps therebetween. These gaps allow the engaging tab 40 inserted into the box 10 to pass. In other words, the first recessed parts 84 serve to guide the engaging tab 40 inserted from the slit 32 into the box 10. Because the cushioning member 80 has these first recessed parts 84, the engaging tab 40 inserted into the slit 32 can advance in the right direction through the gap and thus is prevented from being inserted into a wrong part. The first recessed parts 84 are an example of a first concave portion of the present invention.

Referring back to FIG. 3, the description of the shape of the cushioning member 80 will be continued.

The cushioning member 80 is provided with second recessed parts 85, which are continuous with the corresponding first recessed parts 84, at positions shifted in phase from one another by 90°, similarly to the first recessed parts 84. The first recessed parts 84 are recessed in the horizontal direction so as to leave gaps between the first recessed parts 84 and the inner walls of the box 10 when the cushioning member 80 is stored in the box 10. The second recessed parts 85 are recessed upward, toward the opening 19 in the box 10, and are open to the lower side (arrow Z direction), when the cushioning member 80 is stored in the box 10.

Because the second recessed parts 85 are recessed upward, walls 86 extending downward (in the arrow Z direction) are formed on both sides of the second recessed parts 85. As has been described above, the second recessed parts 85 have the dimension d2, which is substantially equal to or slightly smaller than the dimension, d1, of the portion of the engaging tab 40 shown in FIG. 1. Therefore, as has been described above, the engaging tab 40 inserted from the slit 32 into the box 10 passes through the gap between the inner wall of the box 10 and the first recessed part 84 in the cushioning member 80, reaches the second recessed part 85, which is open to the lower side, and is retained, as a result of the wing parts 42 of the engaging tab 40 being engaged with the second recessed part 85.

Figure 5:
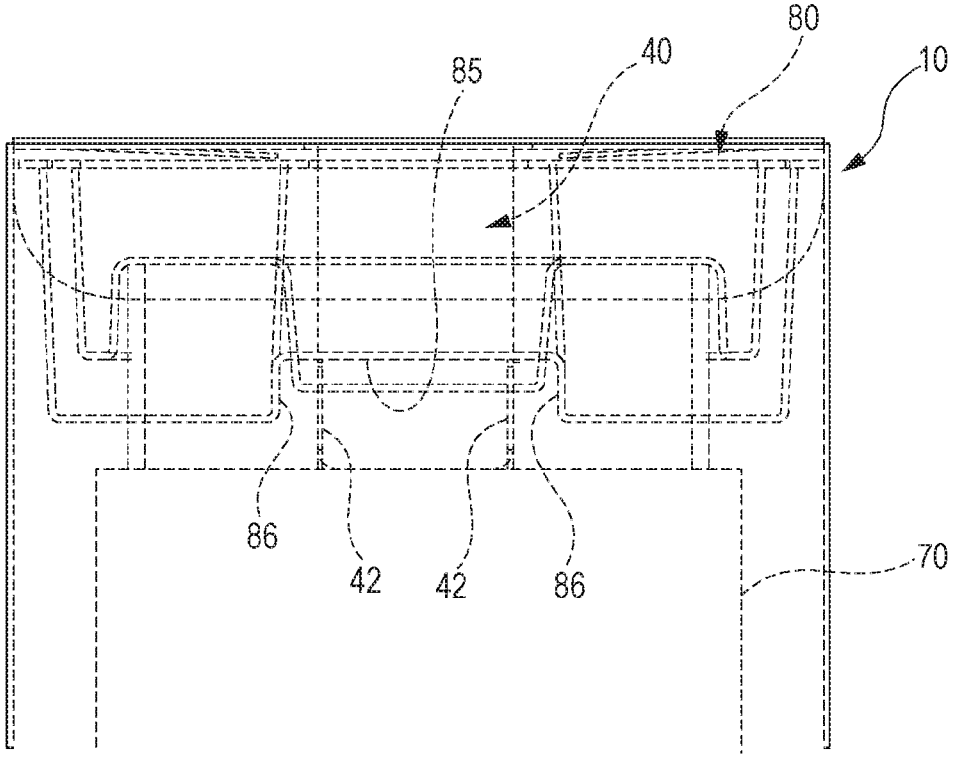
FIG. 5 is a side view showing an engaging tab portion of the box whose a lid is completely closed, as shown in FIG. 2D.

FIG. 5 is a side view showing the engaging tab of the box whose lid is completely closed, as shown in FIG. 2D.

FIG. 5 shows the engaging tab 40 whose wing parts 42 have reached the second recessed part 85 and are in a state folded perpendicularly to the base part 41. These wing parts 42 are not necessarily maintained in a state folded perpendicularly to the base part 41, as shown in FIG. 5, but tend to open, due to their own elasticity, in directions away from the base part 41 (in directions in which they are unfolded). If the wing parts 42 open until they are substantially flush with the base part 41, the wing parts 42 may pass between the inner wall of the box 10 and the cushioning member 80, thus allowing the first lid 20 to be partly opened. However, in this cushioning member 80, the second recessed parts 85, which are open to the lower side, are formed, and the walls 86 are formed on both sides of the second recessed parts 85, correspondingly. Hence, the wing parts 42 that have reached the second recessed part 85 abut on the walls 86 on both sides thereof when they open to some extent and cannot open any further. Accordingly, by forming the second recessed parts 85 in the cushioning member 80, the wing parts 42 are maintained in a folded state, and reliable engagement is maintained by the wing parts 42.

As has been described above, in this exemplary embodiment, by making the cushioning member 80, among the product 70 and the cushioning member 80 stored in the box 10, have a characteristic shape, reliable engagement of the engaging tab 40, in other words, a tamper-proof structure is achieved. Thus, according to this exemplary embodiment, there is no need to make the product 70, which is the principal storage item, have a characteristic shape for enabling engagement with the engaging tab 40. However, the engaging tab 40 may be engaged with the product 70 by utilizing the shape of the product 70.

In this exemplary embodiment, when the product 70 is taken out of the box 10 that is in the form of a package enclosing the product 70 and the like, first, a force is applied to the first lid 20, serving as an outer cover, to break the first lid 20 along the perforation lines 21 (see FIG. 1), and thus, the first lid 20 is opened. Then, the tab 33 of the second lid 30 is pulled up to open the second lid 30. As a result, the product 70 stored in the box 10 can be taken out of the box 10. Although the first lid 20 is broken by opening the package, the second lid 30 is left unbroken. Therefore, when, for example, the product 70 taken out of the box 10 is used to replace a used product 70, the box 10 can be used to store the used, replaced product 70 or the like.

Although the box 10 having a square opening 19 has been described above, the present invention may be applied to a box having a rectangular opening or to a box having an opening in the shape other than a rectangular shape, such as a hexagonal shape.

Although, herein, the bottom part 11 (see FIG. 1) of the box 10 is glued in the process of forming the box and, hence, cannot be opened, a lid having the same structure as the top part 13 of the box 10 may be provided at the bottom part 11, and the cushioning members may be provided at both the top and bottom parts within the box, so that the product 70 and the like can be inserted from either of the top and bottom parts.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A box comprising:

a box body having an opening surrounded by a plurality of edges;

a first lid body that is continuous with and extends from a first edge, among the plurality of edges defining the opening in the box body, and that is foldable along the first edge to overlie the opening; and an engaging tab that is continuous with and extends from a second edge, which is different from the first edge, among a plurality of edges of the first lid body, and that is foldable and engageable with a storage item stored in the box body when the first lid body is folded along the first edge to overlie the opening, wherein the second edge is an edge of the first lid body.

2. The box according to claim 1, further comprising a second lid body that is continuous with a third edge, which is different from the first edge, among the plurality of edges defining the opening in the box body, and that is foldable along the third edge to cover, on an inner side of the first lid body, the opening.

3. A package comprising:

a box including a box body having an opening surrounded by a plurality of edges, and a first lid body that is continuous with a first edge, among the plurality of edges defining the opening in the box body, and that is foldable along the first edge to overlie the opening; and a storage item stored in the box, wherein the box further includes an engaging tab that is continuous with a second edge, which is different from the first edge, among a plurality of edges of the first lid body, and that is foldable along the second edge so as to extend into the box body and is engageable with the storage item stored in the box body, wherein the storage item has an engaging part that engages with the engaging tab, and wherein the second edge is an edge of the first lid body.

4. The package according to claim 3, wherein the storage item has a first concave portion at a position corresponding to the engaging tab extending into the box body, the first concave portion forming a gap, into which the engaging tab is guided, between the first concave portion and an inner wall of the box body.

5. The package according to claim 3, wherein the engaging tab includes a base part extending from the second edge, and a pair of wing parts that extend from a distal end of the base part, in directions parallel to the second edge, and that are foldable along edges of the base part, and wherein the storage item has a second concave portion recessed toward the opening and engageable with the pair of wing parts while maintaining the pair of wing parts in a folded state.

6. The package according to claim 4, wherein the engaging tab includes a base part extending from the second edge, and a pair of wing parts that extend from a distal end of the base part, in directions parallel to the second edge, and that are foldable along edges of the base part, and wherein the storage item has a second concave portion recessed toward the opening and engageable with the pair of wing parts while maintaining the pair of wing parts in a folded state.

7. The package according to claim 3, wherein the storage item can be stored in the box in any of a plurality of orientations that differ from one another in an angle about a normal line to the opening, and wherein the engaging part includes a plurality of engaging parts provided at a plurality of positions that differ from one another in the angle about the normal line.

8. The package according to claim 4, wherein the storage item can be stored in the box in any of a plurality of orientations that differ from one another in an angle about a normal line to the opening, and wherein the engaging part includes a plurality of engaging parts provided at a plurality of positions that differ from one another in the angle about the normal line.

9. The package according to claim 5, wherein the storage item can be stored in the box in any of a plurality of orientations that differ from one another in an angle about a normal line to the opening, and wherein the engaging part includes a plurality of engaging parts provided at a plurality of positions that differ from one another in the angle about the normal line.

10. The package according to claim 6, wherein the storage item can be stored in the box in any of a plurality of orientations that differ from one another in an angle about a normal line to the opening, and wherein the engaging part includes a plurality of engaging parts provided at a plurality of positions that differ from one another in the angle about the normal line.

11. The package according to claim 3, wherein the storage item includes a principal storage item and a cushioning member that is disposed on a side closer to the opening than the principal storage item, and wherein the engaging part is provided in the cushioning member.

12. The package according to claim 4, wherein the storage item includes a principal storage item and a cushioning member that is disposed on a side closer to the opening than the principal storage item, and wherein the engaging part is provided in the cushioning member.

13. The package according to claim 5, wherein the storage item includes a principal storage item and a cushioning member that is disposed on a side closer to the opening than the principal storage item, and wherein the engaging part is provided in the cushioning member.

14. The package according to claim 6, wherein the storage item includes a principal storage item and a cushioning member that is disposed on a side closer to the opening than the principal storage item, and wherein the engaging part is provided in the cushioning member.

15. The package according to claim 7, wherein the storage item includes a principal storage item and a cushioning member that is disposed on a side closer to the opening than the principal storage item, and wherein the engaging parts are provided in the cushioning member.

16. The package according to claim 8, wherein the storage item includes a principal storage item and a cushioning member that is disposed on a side closer to the opening than the principal storage item, and wherein the engaging parts are provided in the cushioning member.

17. The package according to claim 9, wherein the storage item includes a principal storage item and a cushioning member that is disposed on a side closer to the opening than the principal storage item, and wherein the engaging parts are provided in the cushioning member.

18. The package according to claim 10, wherein the storage item includes a principal storage item and a cushioning member that is disposed on a side closer to the opening than the principal storage item, and wherein the engaging parts are provided in the cushioning member.

19. A package comprising:

a box including a box body having an opening surrounded by a plurality of edges, and a first lid body that is continuous with a first edge, among the plurality of edges defining the opening in the box body, and that is foldable along the first edge to overlie the opening; and a storage item stored in the box, wherein the box further includes an engaging tab that is continuous with a second edge, which is different from the first edge, among a plurality of edges of the first lid body, and that is foldable along the second edge so as to extend into the box body and is engageable with the storage item stored in the box body, wherein the storage item has an engaging part that engages with the engaging tab, and wherein the storage item has a first concave portion at a position corresponding to the engaging tab extending into the box body, the first concave portion forming a gap, into which the engaging tab is guided, between the first concave portion and an inner wall of the box body.

20. A package comprising:

a box including a box body having an opening surrounded by a plurality of edges, and a first lid body that is continuous with a first edge, among the plurality of edges defining the opening in the box body, and that is foldable along the first edge to overlie the opening; and a storage item stored in the box, wherein the box further includes an engaging tab that is continuous with a second edge, which is different from the first edge, among a plurality of edges of the first lid body, and that is foldable along the second edge so as to extend into the box body and is engageable with the storage item stored in the box body, wherein the storage item has an engaging part that engages with the engaging tab, wherein the engaging tab includes a base part extending from the second edge, and a pair of wing parts that extend from a distal end of the base part, in directions parallel to the second edge, and that are foldable along edges of the base part, and wherein the storage item has a second concave portion recessed toward the opening and engageable with the pair of wing parts while maintaining the pair of wing parts in a folded state.

* * * * *